US011946393B2

(12) United States Patent
Mariotti

(10) Patent No.: US 11,946,393 B2
(45) Date of Patent: Apr. 2, 2024

(54) CAMSHAFT WITH PHASING DEVICE FOR MULTI-CYLINDER INTERNAL COMBUSTION ENGINE WITH POPPET VALVES

(71) Applicant: Piaggio & C. S.p.A., Pontedera (IT)

(72) Inventor: Walter Mariotti, Pontedera (IT)

(73) Assignee: PIAGGIO & C. S.P.A., Pontedera (IT)

( * ) Notice: Subject to any disclaimer, the term of this patent is extended or adjusted under 35 U.S.C. 154(b) by 147 days.

(21) Appl. No.: 17/756,550

(22) PCT Filed: Nov. 26, 2020

(86) PCT No.: PCT/IB2020/061170

§ 371 (c)(1),
(2) Date: May 26, 2022

(87) PCT Pub. No.: WO2021/105915

PCT Pub. Date: Jun. 3, 2021

(65) Prior Publication Data

US 2022/0412236 A1 Dec. 29, 2022

(30) Foreign Application Priority Data

Nov. 27, 2019 (IT) ..... 102019000022284

(51) Int. Cl.
*F01L 1/344* (2006.01)
*F01L 1/02* (2006.01)
*F01L 1/047* (2006.01)

(52) U.S. Cl.
CPC ..... *F01L 1/34409* (2013.01); *F01L 1/022* (2013.01); *F01L 1/047* (2013.01)

(58) Field of Classification Search
CPC ..... F01L 1/047; F01L 1/022; F01L 1/34409
See application file for complete search history.

(56) References Cited

U.S. PATENT DOCUMENTS

| | | | | |
|---|---|---|---|---|
| 5,497,738 | A | 3/1996 | Siemon et al. | |
| 9,719,381 | B2 | 8/2017 | Yoshimoto et al. | |
| 2002/0062803 | A1* | 5/2002 | Sato | F01L 1/3442 123/90.15 |

FOREIGN PATENT DOCUMENTS

| | | | |
|---|---|---|---|
| FR | 2055094 | A5 | 5/1971 |
| GB | 2080923 | A | 2/1982 |
| JP | 2009185656 | A | 8/2009 |
| JP | 2010031785 | A | 2/2010 |
| JP | 5724669 | B2 | 5/2015 |

OTHER PUBLICATIONS

Patent Cooperation Treaty, International Search Report and Written Opinion for International Application No. PCT/IB2020/061170, dated Mar. 5, 2021, 12 pages.

* cited by examiner

*Primary Examiner* — Ngoc T Nguyen
(74) *Attorney, Agent, or Firm* — Stetina Brunda Garred & Brucker

(57) ABSTRACT

A camshaft for a multi-cylinder internal combustion engine with poppet valves, comprising a main body, which is rotatable with respect to a first rotation axis, a first disk and means of the hydraulic type for varying the timing of said first disk with respect to said main body.

13 Claims, 7 Drawing Sheets

CAMSHAFT WITH PHASING DEVICE FOR MULTI-CYLINDER INTERNAL COMBUSTION ENGINE WITH POPPET VALVES

CROSS-REFERENCE TO RELATED APPLICATIONS

This application claims priority to PCT International Application No. PCT/IB2020/061170 filed on Nov. 26, 2020, which application claims priority to Italian Patent Application No. 102019000022284 filed on Nov. 27, 2019, the disclosures of which are expressly incorporated herein by reference.

STATEMENT RE: FEDERALLY SPONSORED RESEARCH/DEVELOPMENT

Not applicable.

BACKGROUND OF THE INVENTION

Field of the Invention

The present invention belongs to the field of manufacturing multi-cylinder internal combustion engines with poppet valves, in particular for vehicles with a ridable saddle, this expression in general being intended to mean a motorcycle or a motor vehicle with two, three or four wheels, mainly intended for the transport of people. In particular, the present invention relates to the field of manufacturing an engine of the aforesaid type provided with a camshaft for controlling a plurality of said valves (suction or discharge) and a device for changing the phase of said camshaft, i.e. of said valves with respect to the drive shaft.

Background Art

As is known, an internal combustion engine, for example, for a vehicle with a ridable saddle, comprises a drive shaft, the rotation of which is caused by the movement of the pistons inside the combustion chambers of the corresponding cylinders. The engine likewise comprises one or more suction valves for introducing the air-fuel mixture into the combustion chambers, and one or more discharge valves for discharging the combustion gases. The suction valves and the discharge valves are controlled by respective camshafts mechanically connected to the drive shaft through a distribution system, which typically comprises gears, belts or chains. Through the distribution system, the rotation movement of the camshafts is therefore generated by the rotation of the drive shaft, the camshafts being synchronized with the drive shaft.

The term "timing" usually means the moment in which the opening and the closing of the suction and discharge valves occurs with reference to a predetermined position of the piston. In particular, in order to define the timing, the advance (or delay) angle of opening is considered with respect to the BDC (bottom dead center) and the advance (or delay) angle of closing is considered with respect to the UDC (upper dead center). The advance angle is defined by the moment when the valve reaches the position of complete opening/closing, terminating the travel thereof. Therefore, the advance angle values cause the instants in which the valve starts the opening motion thereof (from completely closed) or closing motion (from completely open).

It is equally known that for a time interval, i.e. for a certain rotation angle of the drive shaft, the suction valves and the discharge valves are simultaneously open. This range is called "crossing angle" and is the step in which the exhaust gases quickly leave the combustion chamber, inducing a suction, which allows the suction of fresh gases to be increased. The timing of the suction valves and the discharge valves therefore causes the crossing angle value.

It is equally known that the crossing angle value causes various benefits according to the rotation speed of the drive shaft. An elevated crossing angle value improves performance at high speeds, but at low speeds causes poor efficiency of the engine in addition to an inefficient combustion, and therefore increased emissions. On the contrary, the engine loses efficiency at high rotation speeds if the crossing angle is quite contained.

With respect to the above, various technical solutions have been proposed to vary the timing of the suction valves and/or the discharge valves, i.e. to vary the crossing angle value of the valves, according to the rotation speed.

U.S. Pat. No. 9,719,381 describes one of these technical solutions. Specifically, U.S. Pat. No. 9,719,381 describes an engine in which the distribution system is of the DOHC (double overhead camshaft) type, comprising two camshafts, one intended to control the suction valves and the other the discharge valves, which camshafts are arranged above the engine head. The distribution system comprises a driving gearwheel, which is integral with the drive shaft. The three (driving and driven) wheels are connected by a driving belt. Each of the driven wheels is mounted to the corresponding camshaft close to an end thereof and so as to allow a relative rotation of the camshaft with respect to the wheel itself.

Through the distribution system indicated above, the rotation of the drive shaft is transmitted to the corresponding driven wheel mounted to the corresponding camshaft, wherein, due to the centrifugal force acting on movable mechanical components, it results in the movement of said mechanical components and therefore in a rotation of the camshaft with respect to the driven wheel and therefore in a timing change of the corresponding valves.

Technical solutions similar to that described above are also described in JP20100317855, JP2009185656 and JP 5724669.

Despite achieving the preset functionality, the above technical solutions, and other conceptually similar ones have a number of drawbacks. The main drawback relates to the complexity characterizing the components, which interact to achieve the phase change.

In particular, these known solutions use an elevated number of ball (spherical) components interposed between the driven wheel and the camshaft, which results in a long and burdensome processing both of the driven wheel actuated by the distribution system and of the guide element keyed to the driven camshaft.

Furthermore, it must be considered that the profile of the surfaces of the balls themselves also affects the times and therefore the processing costs of the two components, which form the phase changer device, wherein the balls have a curved profile aimed at ensuring an axial movement of the guide element with respect to the driven wheel.

Another limitation of the described solution relates to the fact that the phase change feature strictly depends on the shape and sizes of the tracks and on the number of driving elements. Therefore, if such a feature is to be changed, there is, in fact, a need to replace the components of the phase changer (the driven wheel actuated by the distribution system and the guide element keyed onto the driven shaft) with others, which are conveniently configured and capable of achieving the different phase change. In fact, a modification of the phase change feature with the known solutions requires a different design of the phase changer components, thus being a significantly burdensome operation.

A further example of a camshaft according to the known art is described in document U.S. Pat. No. 5,497,738.

Objects of the Present Invention

The main task underlying the present invention is thus that of providing a camshaft, in particular for multi-cylinder internal combustion engines with poppet valves, in particular for vehicles with a ridable saddle, which allows the drawbacks indicated above to be overcome or at least reduced in the camshafts of the known type with a phase changer device. Within the scope of this task, it is a first object of the present invention to provide a camshaft provided with a phase changer device, which requires a relatively contained number of driving elements. Another object of the present invention is to provide a camshaft of the aforesaid type with a phase changer device of the hydraulic type, namely based on the exploitation of the energy provided by a pressurized fluid, for example, a hydraulic oil.

Not least object of the present invention is also the provision of a camshaft of the aforesaid type, the timing changer device of which is reliable and easy to manufacture at competitive costs.

Description of the Present Invention

The present invention arises from the general consideration according to which the previously summarized objects can be effectively reached by providing a camshaft including a main body, which is rotatable with respect to a first rotation axis and shaped so as to define a circuit for a pressurized fluid, said camshaft comprising a first driven disk (for example, keyed onto said camshaft) and means for rotating said driven disk with respect to said main body so as to vary the relative angle (timing) between said driven disk and said main body, wherein the variation of said relative angle is obtained by thrust means adapted to be translated by the action of said pressurized fluid so as to act on thrust against respective counterparts of said driven disk.

Based on the above consideration, and with the object of overcoming the drawbacks identified in the phase changer devices according to the prior art and/or achieving the further previously summarized objects, the present invention relates to a camshaft according to claim 1 for multi-cylinder internal combustion engines with poppet valves, embodiments of the present invention being defined by the dependent claims.

According to a described embodiment, a camshaft comprises a main body, which is rotatable with respect to a first rotation axis, a first disk and means for varying the timing of said disk with respect to said main body; wherein said main body is shaped so as to define a circuit for a pressurized fluid; wherein said means for varying the timing of said first disk with respect to said main body comprise first thrust means and second thrust means adapted to be operated by said pressurized fluid and translated along corresponding translation directions, said first and second thrust means being adapted to engage, on thrust, a first counterpart and a second counterpart, respectively, of said first disk; wherein the engagement, on thrust, of said first counterpart by said first thrust means and of said second counterpart by said second thrust means, respectively, results in the rotation of said first disk with respect to a first rotation axis in a first rotation direction and in a second rotation direction, respectively, opposite to said first rotation direction and therefore in the variation of the relative angle between said first disk and said main body.

According to a described embodiment said main body comprises an internal cavity for collecting the pressurized fluid, a pipe, which puts said internal cavity into communication with the outside and a further pipe for conveying the pressurized fluid exiting said internal cavity towards said first thrust means and said second thrust means, wherein a switch is housed inside said further pipe, which is movable between a first position and a second position, and wherein, when said switch is in said first position, said second thrust means are operated by the pressurized fluid and engage, on thrust, said second counterpart, while when said switch is in said second position of said first thrust means, they are operated by the pressurized fluid and engage, on thrust, said first counterpart.

According to a described embodiment, said switch is translatable by centrifugal force along a radial direction to said first rotation axis, depending on the angular speed of the main body.

According to an embodiment, first elastic contrast means are housed in said further pipe and arranged so that the translational switching of said switch from said first position to said second position, is carried out against the elastic resistance exerted by said first elastic contrast means, wherein the translational switching of said switch from said second position to said first position is promoted by the elastic thrust exerted by said first elastic contrast means.

According to a described embodiment, said switch comprises a slide valve, wherein said first thrust means and said second thrust means are housed in a third pipe and in a fourth pipe, respectively, each in fluid communication with said further pipe, wherein said slide valve is shaped so that, when positioned in said first position, said further pipe and said third pipe are put into communication so as to define a closed circuit, which allows the flow of said hydraulic fluid from said further pipe to said third pipe and from said third pipe to said further pipe, while said further pipe and said fourth pipe are put into communication so as to define a blind circuit, which allows the flow of said hydraulic fluid only from said further pipe to said fourth pipe, and wherein said slide valve is shaped so that, when positioned in said second position, said further pipe and said third pipe are put into communication so as to define a blind circuit, which allows the flow of said hydraulic fluid only from said further pipe to said third pipe, while said further pipe and said fourth pipe are put into communication so as to define a closed circuit, which allows the flow of said hydraulic fluid from said further pipe to said fourth pipe and from said fourth pipe to said further pipe.

According to an embodiment described, said slide valve comprises a substantially cylindrical hollow body with a first through hole and a second through hole obtained in the outer wall of said hollow body for connecting the inside of said hollow body to the outside of said hollow body.

According to an embodiment said third pipe and said fourth pipe comprise a first secondary pipe and a second secondary pipe and a third secondary pipe and a fourth secondary pipe, respectively, wherein, with said slide valve in said first position, said first secondary pipe and said second secondary pipe are put into communication with said first through hole and said first pipe, respectively, said second through hole is put into communication with said third secondary pipe, while the communication between said fourth secondary pipe and said first pipe is obstructed by the side wall of said hollow body, and wherein, with said slide valve in said second position, said third secondary pipe and said fourth secondary pipe are put into communication with said second through hole and said first pipe, respectively, said first through hole is put into communication with said first secondary pipe, while the communication between said second secondary pipe and said first pipe is obstructed by the side wall of said hollow body.

According to a described embodiment, said first and second thrust means comprise a first piston and a second piston, respectively, housed in said third pipe and in said fourth pipe, respectively.

According to a described embodiment, second elastic contrast means and third elastic contrast means are housed in said third pipe and in said fourth pipe, respectively, wherein the engagement, on thrust, of said first counterpart and said second counterpart by said first piston and said second piston, respectively, is contrasted by the elastic resistance exerted by said second elastic contrast means and said third elastic contrast means, respectively.

According to an embodiment, a substantially cylindrical hollow insert is housed inside said main body, wherein the internal cavity of said hollow insert is in communication with the internal cavity of said main body and wherein said hollow insert comprises a through hole obtained in the substantially cylindrical outer wall thereof and positioned so as to put said second pipe into communication with the internal cavity of said hollow insert.

According to a described embodiment, a first non-return valve is housed inside said second pipe.

According to an embodiment, a second non-return valve and a third non-return valve are housed respectively inside said first secondary pipe and said third secondary pipe.

The present invention also relates to an internal combustion engine, in particular, for a motor vehicle with a rideable saddle, comprising a drive shaft, at least one camshaft according to one or more of the embodiments of the present invention, wherein the rotation of said main body with respect to said first rotation axis results in the actuation of one or more suction or discharge valves, wherein said engine comprises driving means interposed between said drive shaft and said first disk of said camshaft so that the rotation of the drive shaft generates a rotation of said main body of said at least one first camshaft.

According to an embodiment, said first disk of said at least one camshaft is kinematically connected to said drive shaft by means of a driving chain or belt.

Possible further embodiments of the present invention are defined by the claims.

BRIEF DESCRIPTION OF THE FIGURES

The present invention is further clarified below by means of the following detailed description of the embodiments depicted in the drawings. Moreover, the present invention is not limited to the embodiments described below and depicted in the drawings; on the contrary, all those variants of the embodiments described below and depicted in the accompanying drawings, which are clear to those skilled in the art, fall within the scope of the present invention.

In the drawings.

DETAILED DESCRIPTION OF THE PRESENT INVENTION

Figure 1D:
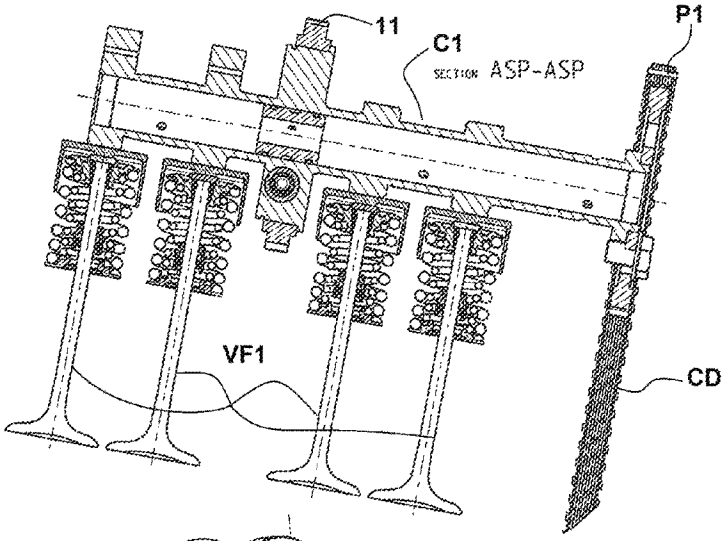
FIGS. 1*a* to 1*d* show a perspective diagrammatic view, a side view, a partial longitudinal sectional side view and a partial sectional view from above, respectively, of a group of components of an engine provided with a camshaft according to an embodiment of the pre sent invention.
Figure 1C:
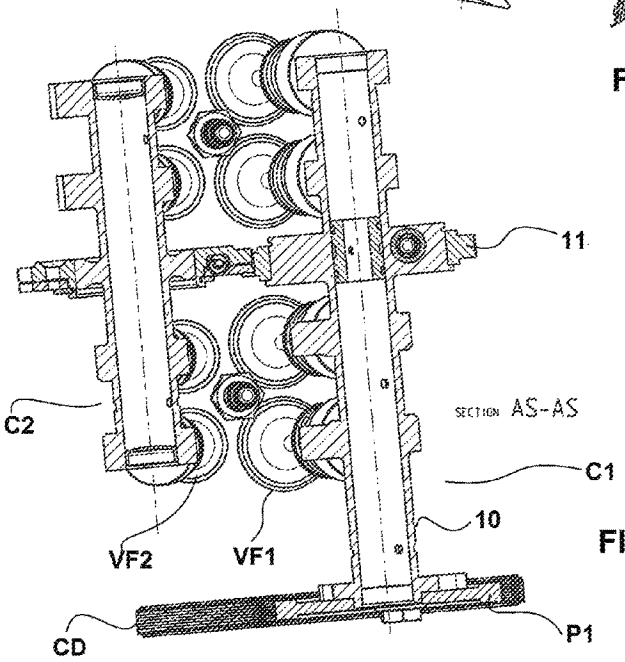
Figure 1B:
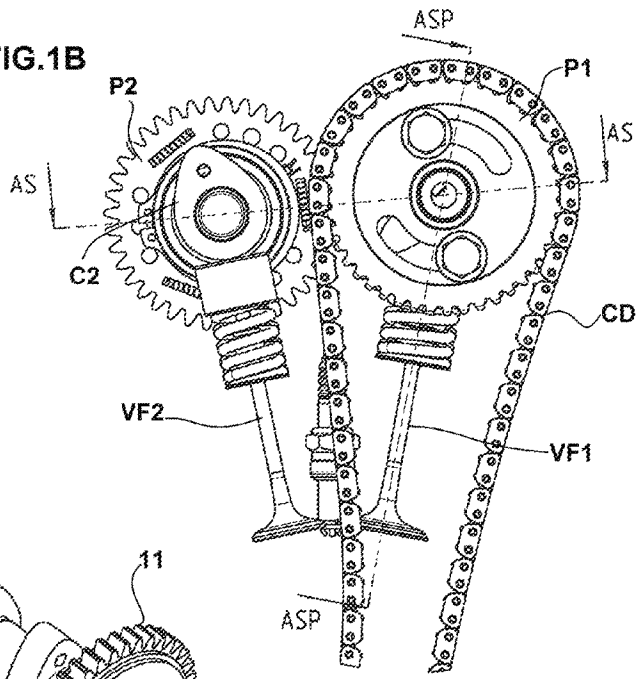
Figure 1A:
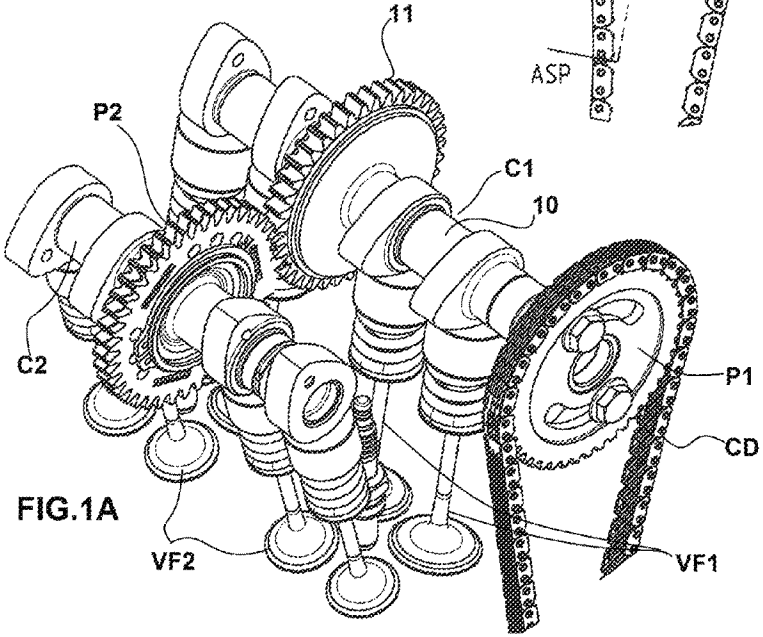
Figures 2A, 2B, 2C:
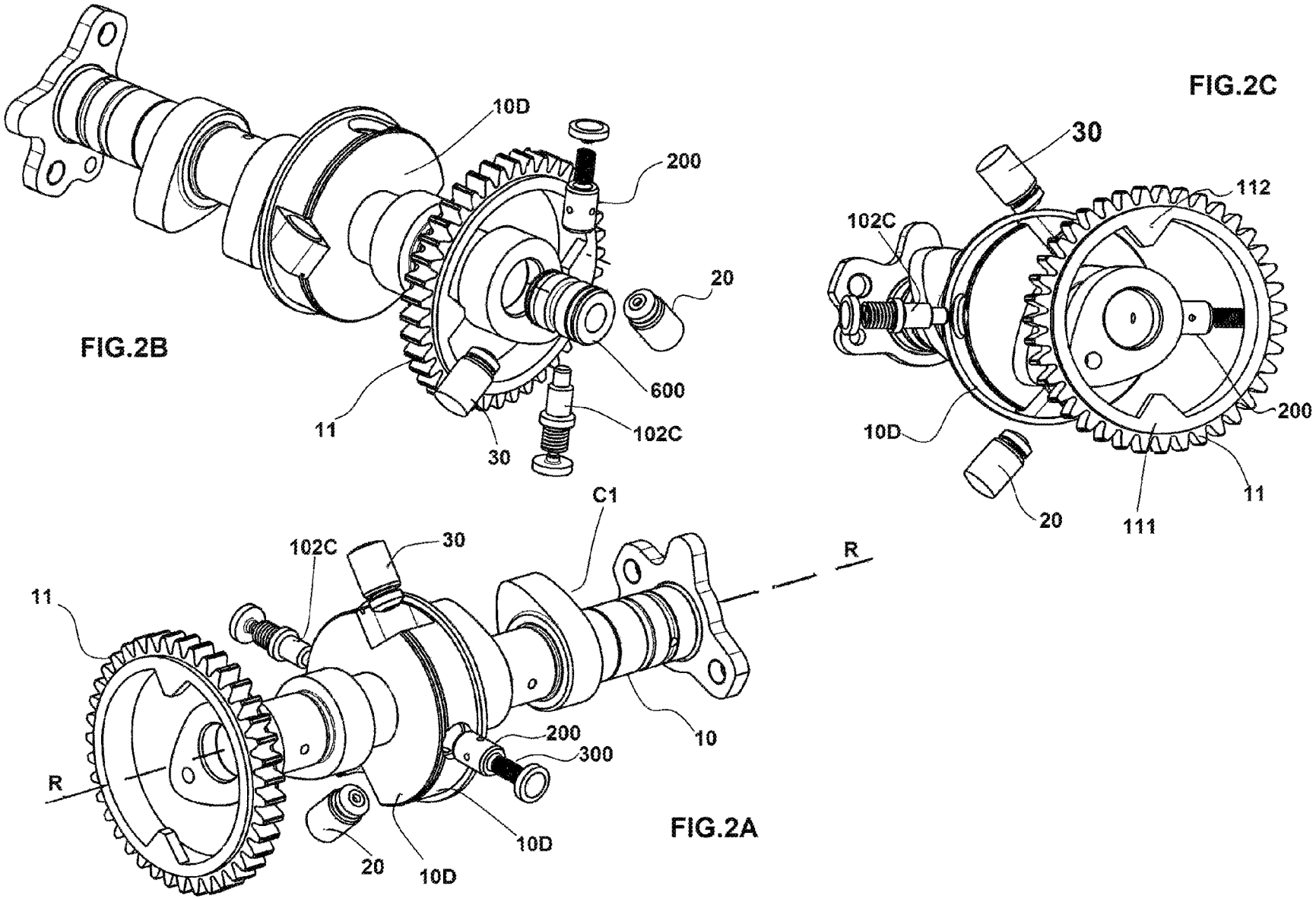
FIGS. 2*a* to 2*c* show exploded perspective views of a camshaft according to an embodiment of the present invention.
Figure 3C:
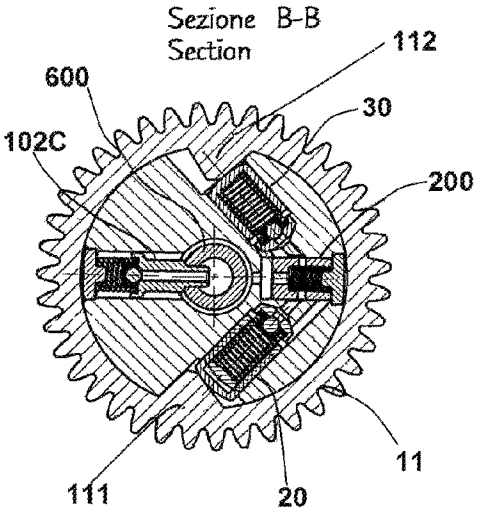
FIGS. 3*a* to 3*c* show a longitudinal side view, a transverse side view and a cross-section of a camshaft, respectively, according to an embodiment of the present invention.
Figure 3A:
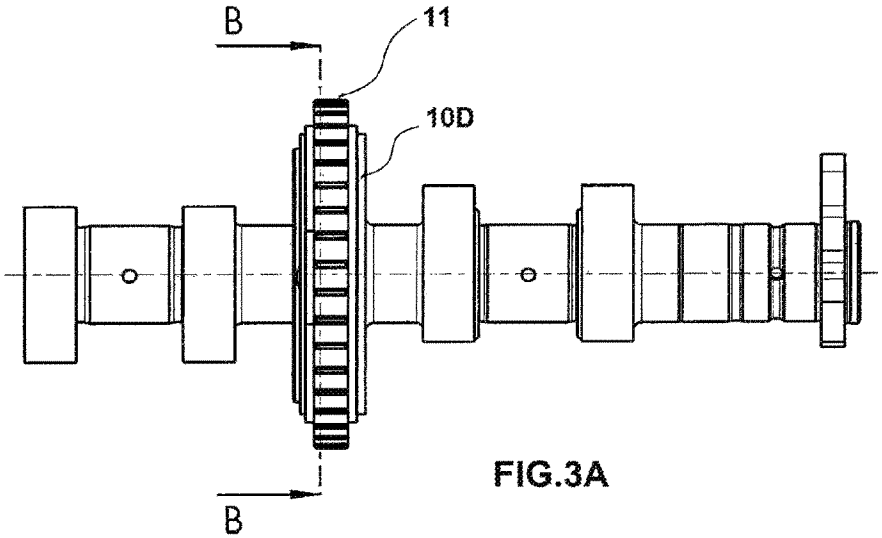
Figure 3B:
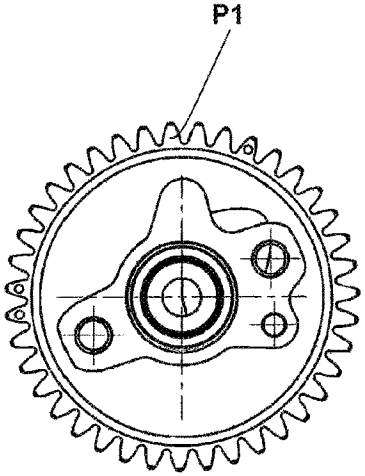
Figure 4:
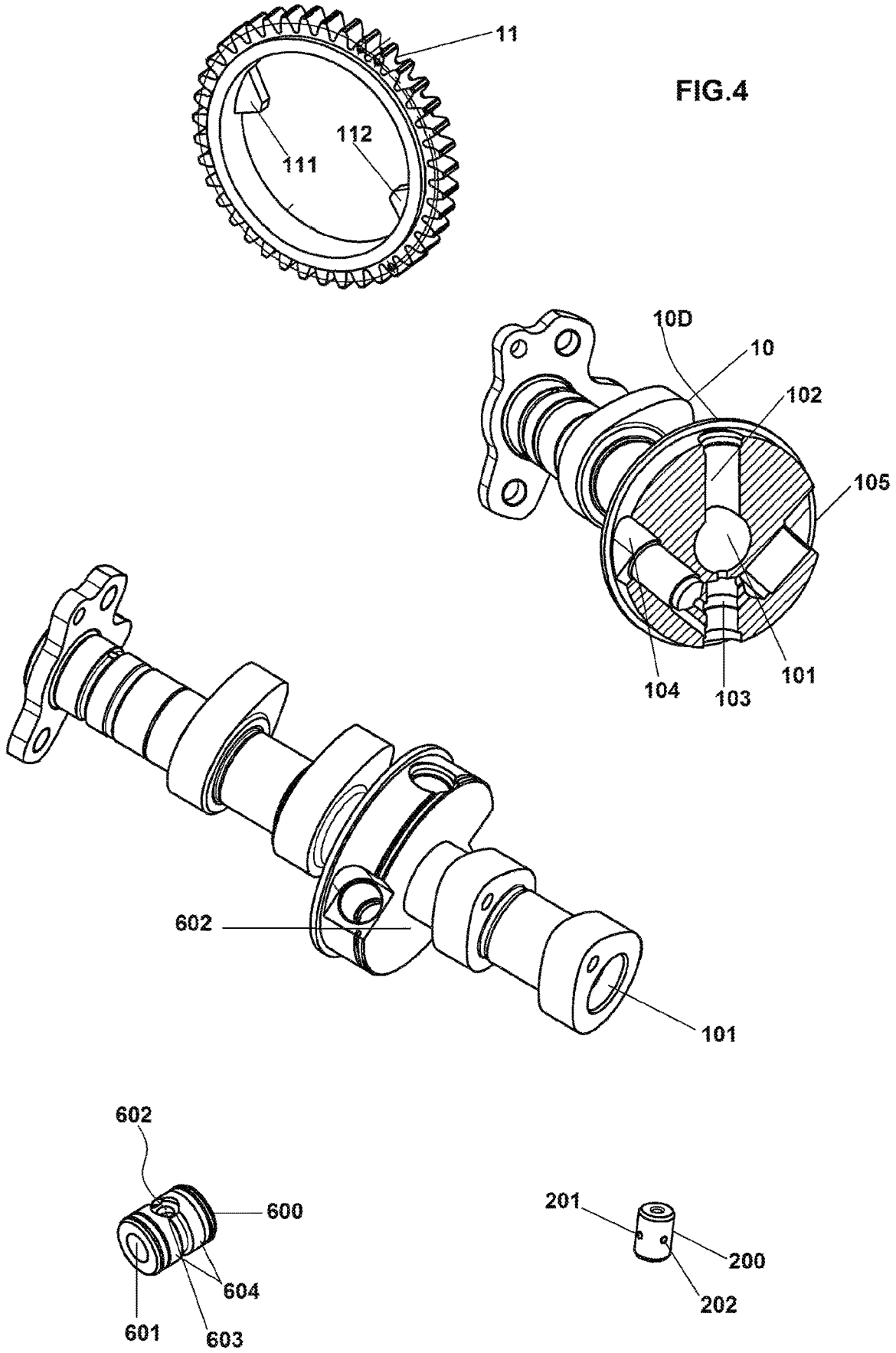
FIG. 4 shows perspective views of component parts of a camshaft according to an embodiment of the present invention.

The present invention finds particularly advantageous application when implemented in multi-cylinder internal combustion engines with poppet valves, in particular, for vehicles with a ridable saddle, this being the reason why the present invention will be described below with possible particular reference to engines of the aforesaid type.

However, the possible applications of the present invention are not limited to engines of the aforesaid type, the present invention being applicable, on the contrary, to all cases requiring a phase change between an element, for example, a driven disk and/or a driver and a body rotated by said driven element and/or driver.

FIGS. 1*a* to 1*d* show component parts of a combustion engine and in particular: a first camshaft C1, a second camshaft C2, first poppet valves VF1 and second poppet valves VF2 operated by said first camshaft C1 and by said second camshaft C2, respectively. The camshaft C1 is rotated by means of a distribution belt CD, which extends between a pinion P1 and the drive shaft (not depicted), while the camshaft C2 is rotated by the shaft C1, wherein, to the purpose, a toothed disk 11 engages a second pinion P2, which is integral with the shaft C2. As described in detail below, the shaft C1 comprises means for varying the timing of the disk 11 with respect to the main body 10 of the shaft C1, and therefore also with respect to the first pinion P1 and to the second pinion P2, wherein varying the timing between the aforesaid components results in the variation of the timing between the drive shaft and the poppet valves VF1 and VF2.

Therefore, a description will be given below of the camshaft according to an embodiment of the present invention and relative means for varying the timing.

As depicted in the drawings, the camshaft C1 comprises a main body 10, which defines a substantially cylindrical internal cavity 101 adapted to allow the passage of a pressurized fluid (for example, a hydraulic oil), for this purpose, the main element 10 being shaped so as to allow the cavity 101 to be put into communication with a hydraulic system (for example, the hydraulic system of a motor cycle), according to methods, which are not essential for the objects of the present invention and which will therefore not be described in detail for the sake of conciseness.

The body or main element 10, which is adapted to be rotated with respect to an axis R-R (substantially coincident with the axis of symmetry of the internal cavity 101) according to the previously explained methods with reference to FIG. 1, is also shaped so as to define a discoid portion 10D, onto the outer edge of which a disk 11 is keyed in a non-rigid manner, the disk 11, on the contrary, being rotatable on the axis R-R with respect to the discoid element 10D, wherein the rotation of the disk 11 with respect to the discoid 10D according to methods clarified in detail below results in a variation of the relative angle between the disk 11 and the discoid 10D (and thus between the disk 11 and the main body 10), said relative angle being understood as the angle with the vertex on the axis R-R between two portions (for example, two notches) of reference of the disk 11 and the discoid 10D, respectively.

In particular, the discoid 10D is shaped to define a second pipe 102, a first pipe 103, a third pipe 104 and a fourth pipe 105, wherein the second pipe 102 is put into communication with the internal cavity 101 by means of a hollow communication element 102*c* (on the end of which, opposite to the cavity 101, there is positioned a non-return valve 102*d*), and wherein also the first pipe 103 is in communication with the cavity 101 for collecting and conveying the hydraulic fluid from the cavity 101 towards thrust means described in detail below.

To this end, a substantially cylindrical hollow insert 600 is positioned inside the cavity 101, at (in correspondence with) the second pipe 102, wherein said hollow insert 600 comprises a through hole 602 obtained in the substantially cylindrical outer wall thereof through which the communication element 102C extends, as anticipated, to put the inside 601 of the hollow body 600, and therefore the internal cavity 101, into communication with the second pipe 102. The outer surface of the insert 600 is shaped so as to define two end shoulders 604 with an equal diameter and substantially equal to that of the cavity 101, and an intermediate portion 603, the diameter of which is smaller than that of the two shoulders 604, the through hole 602 being formed at the portion 603. Finally, each of the two shoulders 604 has a groove inside which a seal-element is housed, for example a gasket, an O-ring or a similar and/or equivalent seal element.

Figure 5:
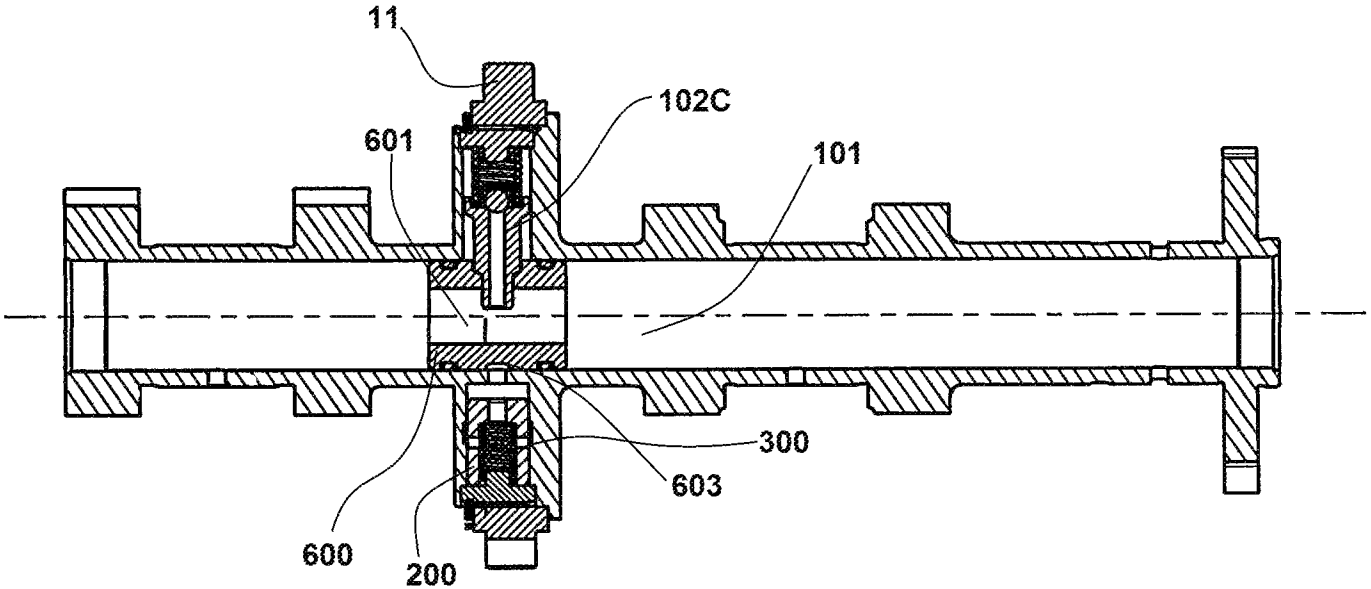
FIG. 5 shows a side section of a camshaft according to an embodiment of the present invention.

Again, as depicted, see for example FIG. 5, the portion 603 with the smaller diameter is put into communication with the first pipe 103, wherein therefore the pressurized flow is conveyed, by means of the element 102*c* from the inside 601 of the insert 600 to the second pipe 102, and from the second pipe 102 to the portion 603 of the insert 600, and thus collected by the portion 603 and conveyed to the first pipe 103.

A switch 200 is also housed in said first pipe 103, which, in the non-limiting embodiment of the present invention depicted in the figures, is made in the form of a small hollow cylinder and comprises a first through hole 201 and a second through hole 202 both obtained in the outer wall of said switch 200 for putting the inside of said switch into communication with the outside, in particular, with the third pipe 104 or the fourth pipe 105, respectively, depending on the position taken by said switch 200 (see the following description). In fact, the switch 200 is translatable inside the first pipe 103 along a substantially radial direction, in particular, moving away from the cavity 101 and towards the cavity 101, wherein the translation of the switch 200 away from the cavity 101 is carried out against the elastic resistance of a spring 300 housed in the switch 200, while the translation towards the cavity 101 is promoted by the elastic response of the spring 300.

Figure 6A:
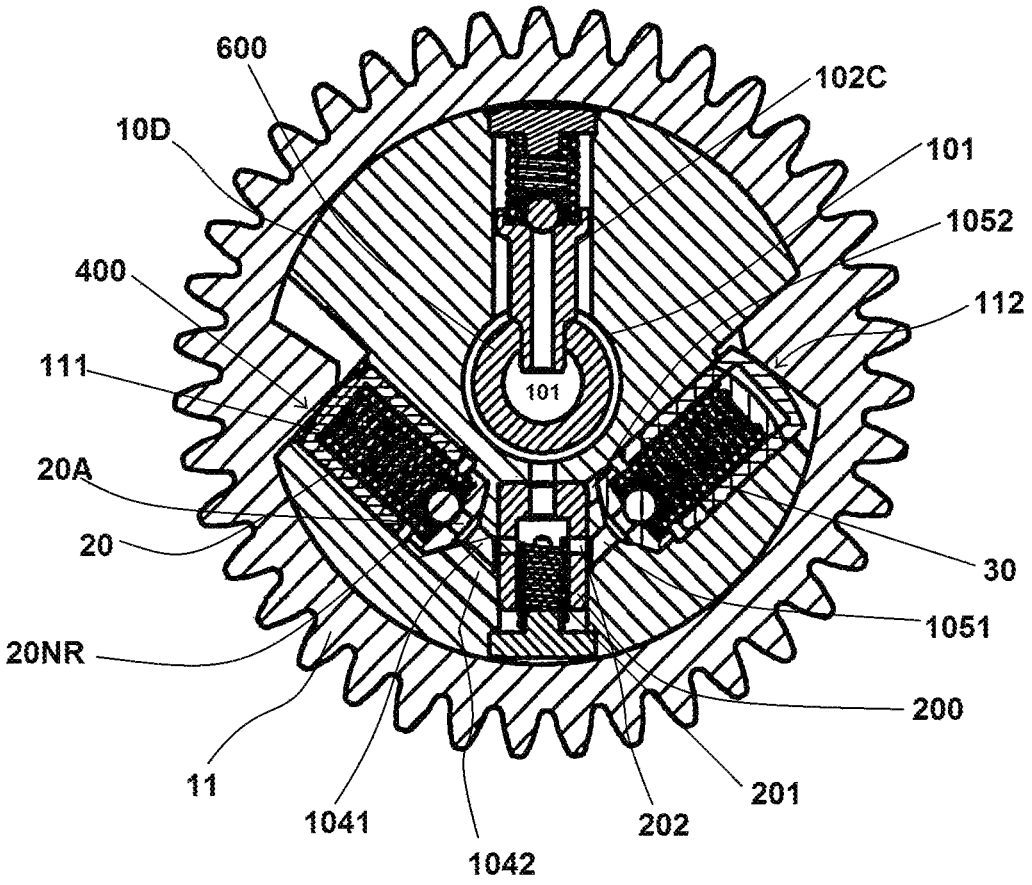
FIGS. 6*a* and 6*b* each show a cross-section of a camshaft according to an embodiment of the present invention.
Figure 6B:
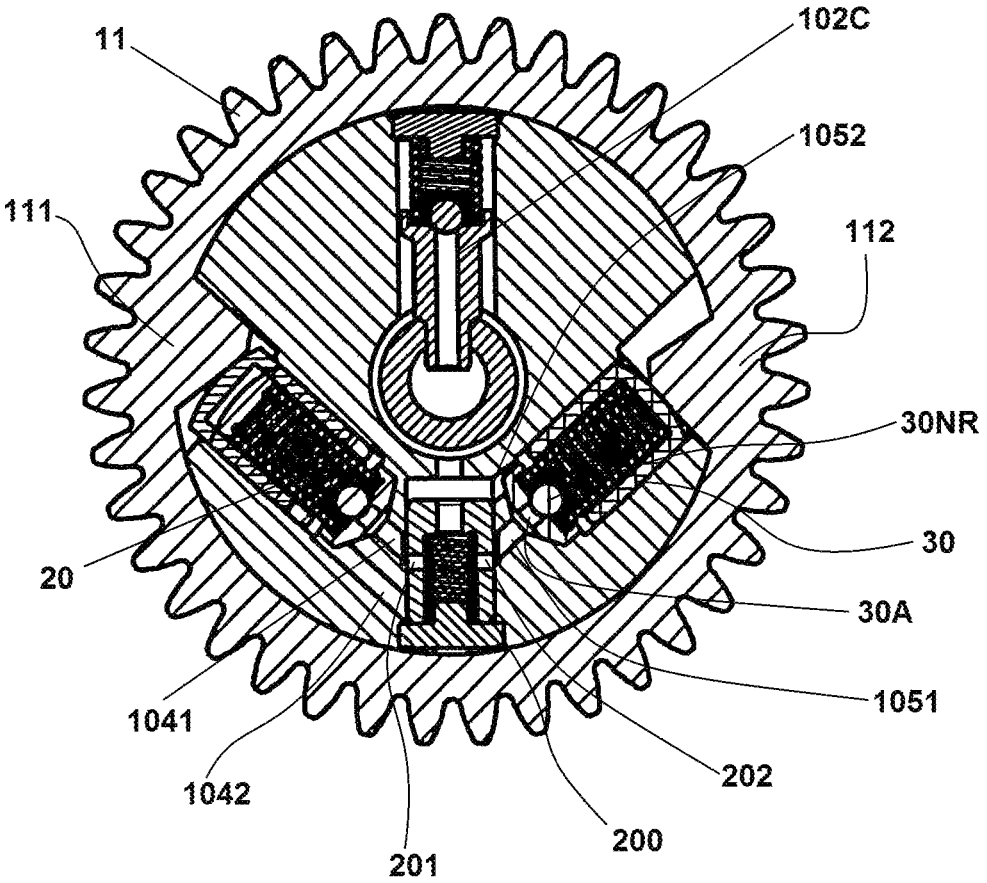

As depicted in detail in FIGS. 6*a* and 6*b*, the third pipe 104 is put into communication with the first pipe 103 by means of a first secondary pipe 1041 and a second secondary pipe 1042, wherein substantially in the same way, the fourth pipe 105 is put into communication with the first pipe 103 by means of a third secondary pipe 1051 and a fourth secondary pipe 1052.

Furthermore, as depicted in detail in FIGS. 6*a* and 6*b*, first thrust means 20 and second thrust means 30 are housed in the third pipe 104 and in the fourth pipe 105, respectively, wherein, being said first and second thrust means substantially similar, a description will be given below of said first thrust means 20 for the sake of conciseness.

Still as depicted, the thrust means 20 are made in the form of a hollow piston, the internal space of which is put into communication with the outside by means of a through opening 20A at which a non-return valve 20NR is placed, a coil spring 400 being positioned inside the hollow piston 20.

The piston 20 is also translatable inside the fourth pipe 104 along a substantially radial direction, in particular, away from the first pipe 103 and towards the first pipe 103, wherein the opening of the non-return valve 20NR and the consequent translation of the piston 20 away from the first pipe 103 are carried out against the elastic resistance of the spring 400, while the closing of the valve 20NR and the translation of the piston 20 towards the first pipe 103 are promoted by the elastic response of the spring 400.

Finally, it is pointed out that the disk 11 comprises a first counterpart and a second counterpart 112, which both extend towards the center of said disk 11, and are adapted to be engaged on thrust by the first piston 20 and by the second piston 30, respectively.

The operation modes of the camshaft C1 according to the embodiment of the present invention as depicted in the figures can be summarized as follows.

The pressurized fluid transiting into the cavity 101 of the main body 10 flows through the element 102*c* into the second pipe 102, from here into the portion 603 of the insert 600 and then from here into the first pipe 103 (see previous description).

The rotation of the main body 10 generated by the rotation of the drive shaft results in a centrifugal force acting on the switch 200. However, at low speeds, the centrifugal force is not sufficient to overcome the resistance of the spring 300, wherein the switch 200 stays positioned in the position in FIG. 6*a*, i.e. in the end-stop position closest to the cavity 101.

In this position, said first pipe 103 and said third pipe 104 are put into communication so as to define a closed circuit, which allows said hydraulic fluid to flow from said first pipe 103 to said third pipe 104 and from said third pipe 104 to said first pipe 103, while said first pipe 103 and said fourth pipe 105 are put into communication so as to define a blind circuit, which allows said hydraulic fluid to flow only from said first pipe 103 to said fourth pipe 105.

In fact, with the switch 200 (also referred to as the slide valve), in said first end-stop position, said first secondary pipe 1041 and said second secondary pipe 1042 are put into communication with said through hole 201 and said first pipe 103, respectively, wherein therefore the circulation of the pressurized fluid between the first pipe 103 and the third pipe 104 does not result in a thrust on the piston 20, which is therefore not brought to act on thrust against the counterpart 111 but which, on the contrary, is free to translate towards the first pipe 103. On the contrary, with the switch or slide valve 200 in said first end-stop position (FIG. 6*a*), said second through hole 202 is put into communication with said third secondary pipe 1051, while the communication between said fourth secondary pipe 1052 and said first pipe 103 is obstructed by the side wall of the switch 200. In this case, the pressure of the fluid entering the third secondary pipe 1051 results in the non-return valve 30NR being opened and in the piston 30 being translated away from the first pipe 103, wherein therefore the piston 30 acts, on thrust, against the counterpart 112, and wherein the thrust on the counterpart 112 by the piston 30 results in the disk 11 being rotated with respect to the discoid 10D in a first rotation direction (clockwise with respect to the figures), and thus, in a change of the timing and/or of the relative angle between the disk 11 and the discoid 10D.

However, with the increase in the rotation speed of the drive shaft, and therefore of the main body 10, the centrifugal force acting on the switch 200 increases until it overcomes the resistance of the spring 300, wherein, at a predefined rotation speed (depending on the resistance of the spring 300), the switch 200 translates away from the cavity 101 until it reaches the second end-stop position in FIG. 6*b*.

With the switch 200 in said second end-stop position, said first pipe 103 and said third pipe 104 are put into communication so as to define a blind circuit, which allows the flow of said hydraulic fluid only from said first pipe 103 to said third pipe 104, while said first pipe 103 and said fourth pipe 105 are put into communication so as to define a closed circuit, which allows the flow of said hydraulic fluid from said first pipe 103 to said fourth pipe 105 and from said fourth pipe 105 to said first pipe 103. In fact, in this case, said third secondary pipe 1051 and said fourth secondary pipe 1052 are put into communication with said second through hole 202 and said first pipe 103, respectively, said first through hole 201 being put into communication with said first secondary pipe 1041, wherein, on the contrary, the communication between said second secondary pipe 1042 and said first pipe 103 is obstructed by the side wall of said switch 200.

The circulation of the hydraulic fluid between the first pipe 103 and the fourth pipe 105 does not result in a translation of the piston 30 away from the second pipe 103, wherein the piston 30 is not brought to act, on thrust, against the counterpart 112 but, on the contrary, it is free to translate towards the second pipe 103.

On the contrary, the pressure of the fluid entering the first secondary pipe 1041 results in the non-return valve 20NR being opened and in the piston 20 being translated away from the first pipe 103, wherein therefore the piston 20 acts, on thrust, against the counterpart 111, and wherein the thrust on the counterpart 111 by the piston 20 results in the disk 11 being rotated with respect to the discoid 10D in a second rotation direction (in this case, anti-clockwise with respect to the figures), and thus, in a new change of the timing and/or of the relative angle between the disk 11 and the discoid 10D.

Thus, it has been demonstrated by the detailed description of the embodiments of the present invention as depicted in the drawings, that the present invention allows the preset objects to be achieved, overcoming the drawbacks and/or disadvantages encountered in the solutions according to the prior art.

For example, the present invention provides a camshaft, in particular for multi-cylinder internal combustion engines with poppet valves, in particular, for vehicles with a ridable saddle, which enables the drawbacks identified in the camshafts with a phase changer device according to the prior art to be overcome, or at least reduced. In particular, a camshaft is provided, by means of the present invention, equipped with a phase changer device, which requires a relatively contained number of drive elements, is of the hydraulic type, and is therefore based on the exploitation of the energy provided by a pressurized fluid, for example, a hydraulic oil, the device according to the present invention for varying the timing being reliable and easy to manufacture at competitive costs.

Although the present invention has been clarified by means of the description of the embodiments depicted in the drawings, the present invention is not limited to the embodiments described above and depicted in the drawings; to the contrary, all the variants of the embodiments described above and depicted in the drawings which are obvious to those skilled in the art fall within the scope of the present invention.

The scope of the present invention is in fact defined by the appended claims.

The invention claimed is:

1. A camshaft for a multi-cylinder internal combustion engine with poppet valves, comprising a main body, which is rotatable with respect to a first rotation axis, a first disk and means for varying the timing of said first disk with respect to said main body;

wherein said main body is shaped so as to define a circuit for a pressurized fluid;

wherein said camshaft comprises first thrust means and second thrust means, which are adapted to be operated by said pressurized fluid and translated along respective translation directions, said first and said second thrust means being adapted to engage, on thrust, a first counterpart and a second counterpart, respectively, of said first disk;

wherein the engagement on thrust of said first counterpart by said first thrust means and of said second counterpart by said second thrust means, respectively, results in said first disk being rotated with respect to a first rotation axis in a first rotation direction and in a second rotation direction, respectively, opposed to said first rotation direction, and therefore, in the relative angle between said first disk and said main body being varied;

wherein said main body comprises an internal cavity for collecting the pressurized fluid and a first pipe for conveying the pressurized fluid exiting said internal cavity towards said first thrust means and second thrust means, wherein a switch is housed in said first pipe, which is movable between a first position and a second position, and wherein, when said switch is in said first position, said second thrust means are operated by the pressurized fluid and engage, on thrust, said second counterpart, while when said switch is in said second position, said first thrust means are operated by the pressurized fluid and engage, on thrust, said first counterpart;

and wherein said switch is translatable by centrifugal force along a radial direction to said first rotation axis depending on the angular speed of said main body.

2. The camshaft according to claim 1, wherein said main body comprises a second pipe, which puts said internal cavity into communication with the outside.

3. The camshaft according to claim 1, wherein first elastic contrast means are housed in said first pipe and arranged so that the translational switching of said switch from said first position to said second position, is carried out against the elastic resistance exerted by said first elastic contrast means and in that the translational switching of said switch from said second position to said first position, is promoted by the elastic thrust exerted by said first elastic contrast means.

4. The camshaft according to claim 1, wherein said switch comprises a slide valve, wherein said first thrust means and second thrust means are housed in a third pipe and a fourth pipe, respectively, each in fluid communication with said first pipe, wherein said slide valve is shaped so that, when positioned in said first position, said first pipe and said third pipe are put into communication so as to define a closed circuit, which allows the flow of said hydraulic fluid from said first pipe to said third pipe and from said third pipe to said first pipe while said first pipe and said fourth pipe are put into communication so as to define a blind circuit, which allows the flow of said hydraulic fluid only from said first pipe to said fourth pipe, and wherein said slide valve is shaped so that, when positioned in said second position, said first pipe and said third pipe are put into communication so as to define a blind circuit, which allows the flow of said hydraulic fluid only from said first pipe to said third pipe while said first pipe and said fourth pipe are put into communication so as to define a closed circuit, which allows the flow of said hydraulic fluid from said first pipe to said fourth pipe and from said fourth pipe to said first pipe.

5. The camshaft according to claim 4, wherein said slide valve comprises a substantially cylindrical hollow body with a first through hole and a second through hole obtained in the outer wall of said hollow body for connecting the inside of said hollow body to the outside of said hollow body.

6. The camshaft according to claim 5, wherein said third pipe and said fourth pipe comprise a first secondary pipe and a second secondary pipe and a third secondary pipe and a fourth secondary pipe, respectively, wherein with said slide valve in said first position, said first secondary pipe and said second secondary pipe are put into communication with said first through hole and said first pipe, respectively, said second through hole is put into communication with said third secondary pipe, while the communication between said fourth secondary pipe and said first pipe is obstructed by the side wall of said hollow body, and wherein, with said slide valve in said second position, said third secondary pipe and said fourth secondary pipe are put into communication with said second through hole and said first pipe, respectively, said first through hole is put into communication with said first secondary pipe, while the communication between said second secondary pipe and said first pipe is obstructed by the side wall of said hollow body.

7. The camshaft according to claim 4, wherein said first and second thrust means comprise a first piston and a second piston housed in said third pipe and in said fourth pipe, respectively.

8. The camshaft according to claim 7, wherein second elastic contrast means and third elastic contrast means are housed in said third pipe and in said fourth pipe, respectively, and in that the thrust engagement of said first counterpart and said second counterpart by said first piston and said second piston, respectively, is contrasted by the elastic resistance exerted by said second elastic contrast means and said third elastic contrast means, respectively.

9. The camshaft according to claim 1, wherein a substantially cylindrical hollow insert is housed inside said main cam body, wherein the internal cavity of said hollow insert is in communication with the internal cavity of said main body, and wherein said hollow insert comprises a through hole obtained in the outer wall thereof and positioned so as to put into communication said second pipe with the internal cavity of said hollow insert.

10. The camshaft according to claim 1, wherein a first non-return valve is housed in said second pipe.

11. The camshaft according to claim 6, wherein a second non-return valve and a third non-return valve are housed inside said first secondary pipe and said third secondary pipe, respectively.

12. An internal combustion engine for a motor vehicle with a rideable saddle, comprising a drive shaft, at least one camshaft according to claim 1, wherein the rotation of said main body with respect to said first rotation axis results in the actuation of one or more suction or discharge valves, wherein said engine comprises drive means interposed between said drive shaft and said first disk of said camshaft so that the rotation of the drive shaft generates a rotation of said main body of said at least one first camshaft.

13. The internal combustion engine according to claim 12, wherein said first disk of said at least one camshaft is kinematically connected to said drive shaft by means of a drive chain or belt.

* * * * *